US005358019A

United States Patent [19]

Sumner, III

[11] Patent Number: 5,358,019

[45] Date of Patent: Oct. 25, 1994

[54] POCKET CARD HOLDER WITH MONEY CLIP

[76] Inventor: Yancey E. Sumner, III, 7860 SW 129 Ter., Miami, Fla. 33156

[21] Appl. No.: 136,047

[22] Filed: Oct. 14, 1993

Related U.S. Application Data

[63] Continuation of Ser. No. 643,837, Jan. 22, 1991, abandoned.

[51] Int. Cl.[5] ..... A45C 11/18

[52] U.S. Cl. ..... 150/147; 150/137; 24/563; 206/38; 206/39

[58] Field of Search ..... 150/137; 206/38 R, 39, 206/39.7; D11/78.1

[56] References Cited

U.S. PATENT DOCUMENTS

| | | | |
|---|---|---|---|
| D. 155,927 | 11/1949 | Rothkrug | D11/78.1 |
| D. 169,825 | 6/1953 | Schildkraut | D11/78.1 |
| 1,851,013 | 3/1932 | Michaud et al. | D11/78.1 X |
| 2,083,117 | 6/1937 | Cunningham | 206/38 R |
| 3,027,995 | 4/1962 | Littman | 206/38 |
| 3,444,914 | 5/1969 | French et al. | 150/137 X |
| 4,056,139 | 11/1977 | Murt | 150/137 |
| 4,903,376 | 2/1990 | Rosseau | 150/137 X |
| 4,903,745 | 2/1990 | Roman | 150/137 X |

*Primary Examiner*—Sue A. Weaver

*Attorney, Agent, or Firm*—Jacobson, Price, Holman & Stern

[57] ABSTRACT

A thin flat device having a money clip (14) on one side together with two parallel channels (10L,10R) on the reverse side to accommodate credit cards and the like.

1 Claim, 1 Drawing Sheet

POCKET CARD HOLDER WITH MONEY CLIP

This is a continuation of application Ser. No. 07/643,837, filed Jan. 24, 1991, now abandoned.

A rigid one piece pocket receptacle for carrying credit cards, I.D. cards, drivers license, etc. on one side and folding money on the reverse side.

Modern day men's wear fashions so often incorporate close fitting trousers, many without back pockets, which can not accommodate traditional wallets or billfolds. Even mini-card cases used to facilitate the carrying of a essential cash, gas, credit cards, bank cash cards, drivers license, etc. are bulky and cumbersome.

Thereafter inventors created several types of credit card holders and carriers to be carried in the pocket to accommodate credit cards and money. U.S. Pat. No. 3,444,914 to French, Montose and Taylor discloses a credit card carrier including an ingenuous but rather impractical mechanism to remind the owner to reinsert his card before closing, U.S. Pat. No. 4,056,139 to Murt discloses a complex device incorporating two spring clips easily compromised by wear which add unnecessary bulk to a package of money and cards. Both of these inventions incorporate two or more moving parts subject to wear or dysfunction.

OBJECTIVE AND ADVANTAGES

Accordingly, besides the objects and advantages of the simple one piece construction described in my above patent, several objects and advantages of the present invention are:

(a) A slim light weight compact design;
(b) easily manipulated for the extraction and insertion of cards;
(c) with a self adjusting spring money clip to accommodate various quantities of bills.
(d) with no sharp corners to snag and tear clothing;
(d) having no moving parts to provide for long lasting trouble free operation;
(e) while comfortably carried in a pocket producing no unsightly bulge.

DRAWING FIGURES

REFERENCE NUMERALS IN DRAWINGS

10 card channels (10R right, 10L left)
12 spring
14 money clip
16 lip

DESCRIPTION—FIGS. 1 to 4

Figure 1:
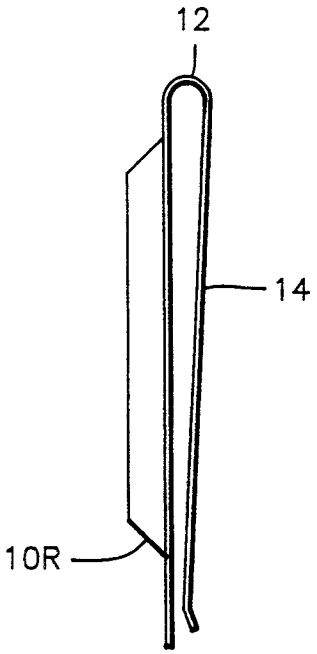
FIG. 1 is the right side view showing the card channel and their relationship to the money clip.
Figure 2:
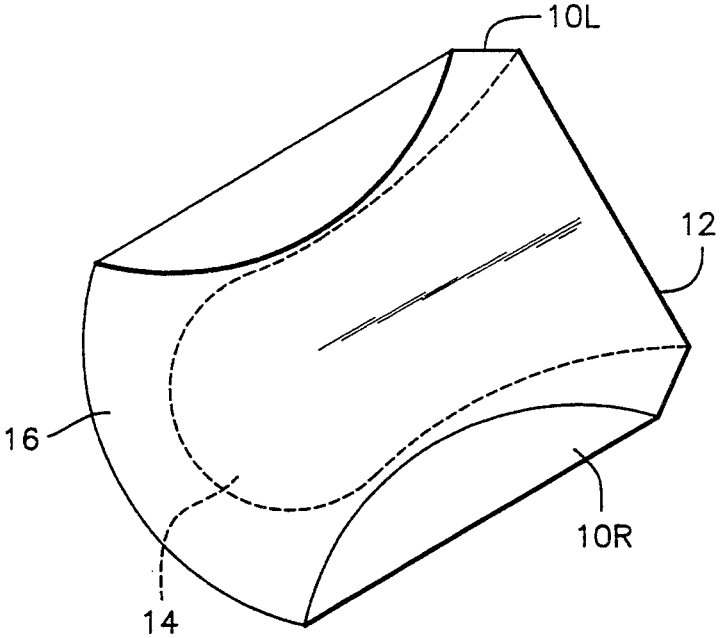
FIG. 2 is the front perspective showing the channels to accommodate credit cards, drivers license, etc.
Figure 4:
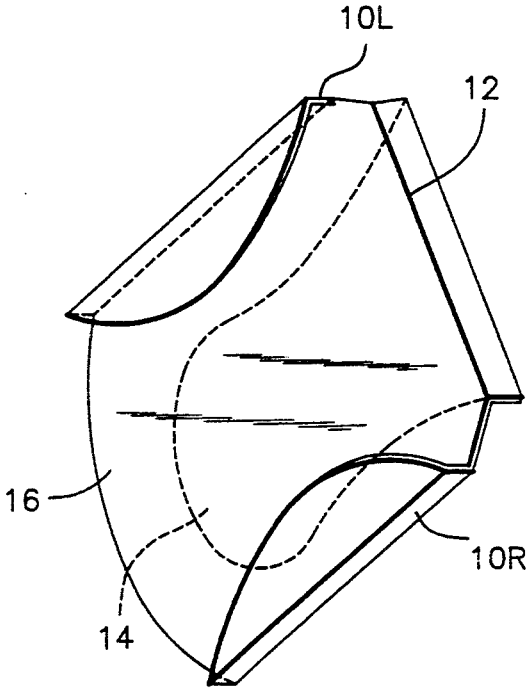
FIG. 4 is a perspective showing the invention.
Figure 3:
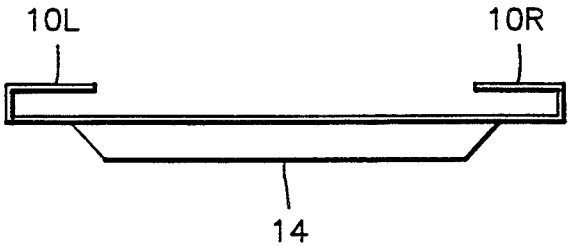
FIG. 3 is the bottom end view showing the card channels and their relationship to the money clip.

A typical embodiment of the present invention is illustrated in perspective in FIG. 4. The holder is fabricated from a flat sheet of rigid material. FIG. 3 illustrates two bends turned parallel to each other and equally distant to two identical mirrored bends forming channels 10L and 10R. The distance between channels 10L and 10R is the width of the cards desired to be retained. The height of the resultant channels are such as to accommodate two or more cards (depending upon the designers choice) stacked one upon the other. FIG. 1 shows a curved bend 12, which is at a right angle and reverse to those bends fabricating channels 10R and 10L, which returns to the back side of the holder thus forming spring 12, and money clip 14. It should be noted that this unique design can be accomplished in an endless number of artistic designs using various types of materials.

From the description above a number of advantages of my design become apparent:

(a) Having no moving parts, the holder will provide many years of maintenance free use.
(b) Being small and compact the holder will easily fit into a pocket with out any noticeable bulge.
(c) Extraction of either money or cards can easily be accomplished with out disturbing the other.
(d) Machine fabrication can easily accomplish the production of the patent.
(e) Having no sharp protruding edges, the holder will not snag or tear clothing.

OPERATION FIG. 2

The manner of using the holder is relatively simple: To insert cards into the holder FIG. 2, grasp the holder between the thumb and forefinger of one hand by the spring end 12 with card channels 10L,10R facing you. With the other hand two or three cards stacked one upon another are placed flat upon the lip 16 and inserted into channels 10L, 10R. Pushing the cards towards the spring end 12 ,the cards are held securely in place by card channels 10L,10R. To extract cards, the holder is held firmly between the thumb and forefinger of one hand with the cards facing you. With the thumb and forefinger of the other hand grasp the cards and pull the cards out of the channels. To hold paper money, using the same thumb and finger, flip the holder over to reveal the money clip. With the other hand, folded currency is inserted under the clip securing it for easy extraction and convenient use.

SUMMARY, RAMIFICATIONS, AND SCOPE

Accordingly the reader will see that this invention affords the user a pocket carrier for credit cards, bank cash cards, identification cards, drivers licenses, business cards, etc. together with a money clip for folded currency which is:

(a) A slim light weight compact design;
(b) easily manipulated for the extraction, insertion and use of cards;
(c) with a self adjusting spring money clip to accommodate various quantities of bills.
(d) with no sharp corners to snag and tear clothing;
(d) having no moving parts assuring long lasting trouble free operation;
(e) which can be comfortably carried in a pocket producing no unsightly bulge.

Although the description above contains many specificities, this should not be construed as limiting the scope of the invention but as merely providing illustrations of some of the presently preferred embodiments of the invention. For example the height and the width of the card channels could be altered to hold more or less cards or different types of cards, such as business cards. The invention could also be designed in other shapes and sizes such as circular, trapezoidal, triangular, etc. The clip itself could be wider longer, or shorter etc.

Thus the scope of the invention should be determined by the appended claims and their legal equivalents, rather then by the examples given.

I claim:

1. A one-piece holder having a size and shape adapted to securely and simultaneously retain both flexible, foldable paper currency and substantially inflexible and rigid plastic cards, said one-piece holder comprising:

a solid longitudinally extending base having a first continuous substantially planar surface and a second, opposed continuous substantially planar surface, two opposed longitudinally extending side edges and two transversely extending end edges, said two end edges extending between respective ends of said longitudinally extending side edges, a resilient retaining member integrally formed with said base, said resilient retaining member extending from one of said two transversely extending end edges over said first continuous substantially planar surface, said resilient retaining member being biased toward said first continuous substantially planar surface, a leading edge of said resilient retaining member being continuously curved for avoiding snagging and tearing of clothing, and two substantially rigid retaining members integrally formed with said base and extending along substantially an entire length of said two opposed longitudinally extending side edges, said two substantially rigid retaining members each including a first portion extending from said second, opposed continuous substantially planar surface, defining a plane extending substantially perpendicular to said second, opposed continuous substantially planar surface, and a second portion extending from said first portion, defining a plane extending substantially perpendicular to said first portion and extending substantially parallel to said second, opposed continuous substantially planar surface, said second portion of said two substantially rigid retaining members terminating in continuously curved edges extending over said second, opposed continuous substantially planar surface for avoiding snagging and tearing of clothing, and said two substantially rigid retaining members defining a retaining channel between said second, opposed continuous planar surface and said two substantially rigid retaining members of a width substantially equal to a width of a credit card.

* * * * *